US006047918A

United States Patent [19]

Saito

[11] Patent Number: 6,047,918

[45] Date of Patent: Apr. 11, 2000

[54] WIRE SPOOL

[75] Inventor: Kazushige Saito, Tokyo, Japan

[73] Assignee: Japan Automatic Machine Co., Ltd., Tokyo, Japan

[21] Appl. No.: 09/237,899

[22] Filed: Jan. 27, 1999

[51] Int. Cl.[7] ..... B65H 75/28

[52] U.S. Cl. ..... 242/580; 242/125.2; 242/611.2

[58] Field of Search ..... 242/580, 125.2, 242/611, 611.2, 125.1, 587

[56] References Cited

U.S. PATENT DOCUMENTS

| | | | |
|---|---|---|---|
| 2,374,111 | 4/1945 | Tourneau | 242/587 |
| 2,936,963 | 5/1960 | Witte | 242/580 |
| 3,481,557 | 12/1969 | Miller | 242/580 |
| 3,622,100 | 11/1971 | Wright | 242/125.2 |
| 4,301,979 | 11/1981 | Cavanagh | 242/125.2 |
| 5,931,408 | 8/1999 | Ishii et al. | 242/580 |

FOREIGN PATENT DOCUMENTS

| | | | |
|---|---|---|---|
| 17275 | 4/1990 | Japan | 242/125.2 |

*Primary Examiner*—John M. Jillions
*Attorney, Agent, or Firm*—Armstrong, Westerman, Hattori, McLeland & Naughton

[57] ABSTRACT

A wire spool for winding therearound a tying wire has a cylindrical wire winding body. A pair of flanges are integrally formed on both axial ends of the wire winding body. One of the flanges has formed on an outer periphery thereof a pair of notches in close proximity to each other. Between those sides which form one of the notches, that side which lies closer to the other of the notches is formed so as to expand an opening of said one of the notches. Between those sides which form the other of the notches, that side which lies farther from said one of the notches is provided with an overhung portion so as to narrow an opening of the other of the notches.

4 Claims, 4 Drawing Sheets

WIRE SPOOL

BACKGROUND OF THE INVENTION

1. Field of the Invention

The present invention relates to a wire spool (or a wire reel) which is used in a binding machine or tying machine for binding together a crossing portion, an overlapped portion, or the like, of reinforcing bars with a tying wire.

2. Description of the Related Art

As this kind of binding machine, there has conventionally been known a portable binding machine, e.g., as disclosed in U.S. Pat. No. 5,505,504. With this machine, a tying wire is wound around a crossing portion, an overlapped portion, or the like, of reinforcing bars to be used in concrete structures, or the like, and the tying wire is then tightened and is finally cut. In this binding machine, the tying wire is wound around a spool (or a reel), and the spool with the tying wire wound therearound is detachably mounted on the binding machine. Once the tying wire has been used up, the blank wire spool left in the binding machine is replaced with a new wire spool with a tying wire wound therearound. As the tying wire, there is normally used a wire of a circular cross section, but one with a square cross section which has a directivity in bending and is easy in binding is also used.

The tying wire is shipped or delivered from a manufacturing factory in a state in which it is wound around the spool. Before delivering, an outer or terminal end of winding of the tying wire is fixed or adhered to the wire spool with an adhesive tape attached thereto in order to prevent the tying wire from becoming loose or unwound. The adhesive tape must have a relatively strong adhesive force which is strong enough to resist that elastic force of the tying wire which urges the tying wire to loosen from the wound state. The work of adhering this adhesive tape to secure the terminal end of the tying wire in position is troublesome and time-consuming. In addition, when the wire spool is put to use, the adhesive tape must be completely removed to prevent it from being rolled into the binding machine. Since the adhesive force of the adhesive tape is relatively strong, the peeling off of the adhesive tape is not easy. Even if the adhesive tape is removed, the adhesive agent remaining on the tying wire gets accumulated inside the binding machine. This sometimes results in a mechanical trouble of the winding machine.

In view of the above-described problems with the conventional winding machine, the present invention has an object of providing a wire spool in which the terminal end of the tying wire can be easily fixed to the wire spool or held in position and also in which the tying wire can be easily released out of the secured state.

SUMMARY OF THE INVENTION

In order to attain the above and other objects, the present invention is a wire spool for winding therearound a tying wire comprising: a cylindrical wire winding body; a pair of flanges integrally formed on both axial ends of said wire winding body. One of the flanges has formed on an outer periphery thereof a pair of notches in close proximity to each other. Between those sides which form one of the notches, that side which lies closer to the other of the notches is formed so as to expand an opening of said one of the notches. Between those sides which form the other of the notches, that side which lies farther from said one of the notches is provided with an overhung portion so as to narrow an opening of the other of the notches.

Preferably, among the sides which form the other of the notches, that side which lies closer to said one of the notches is inclined so as to expand the opening of the other of the notches. And, preferably, the wire winding body has a hole which is made up of a polygonal hole and an axial circular hole which is smaller in diameter than the polygonal hole. The wire winding body has a throughgoing hole which penetrates from an outer periphery of the wire winding body for engaging an inner terminal end of the tying wire.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

A preferred embodiment of this invention will now be explained with reference to the accompanying drawings.

Figure 1:
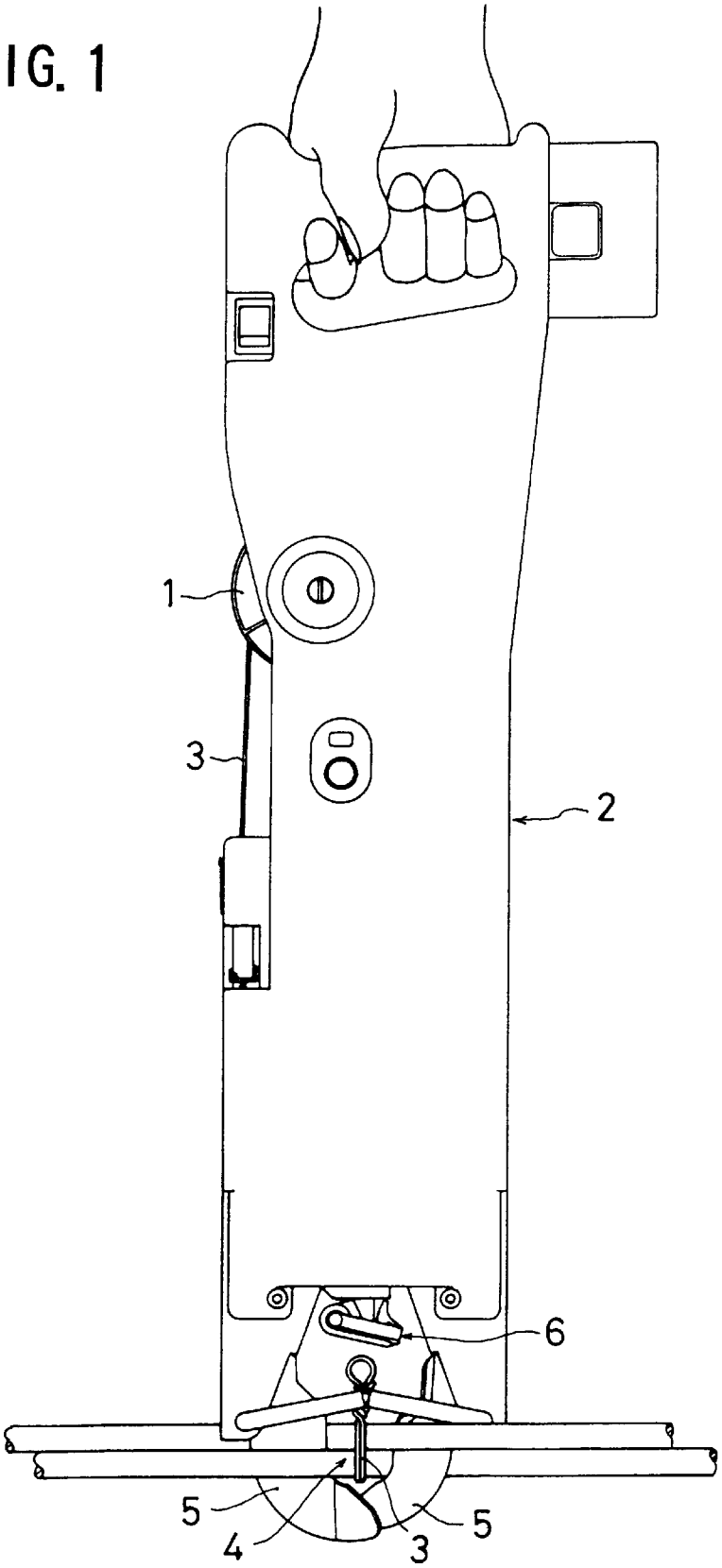
FIG. 1 is an overall view of one embodiment of the present invention.

In FIG. 1, reference numeral 1 denotes a wire spool of the present invention which is mounted on a winding machine 2. A wire 3 which is wound around the wire spool 1 and which is square in cross section of 1 mm in one side or a wire of circular cross section which is 1 mm in diameter is withdrawn or pulled toward a beak-shaped bending guide 5 which can be opened and closed to enclose a crossing portion 4 of reinforcing bars on a construction site. Once the tying wire 3 has been formed into a loop around the crossing portion 4, the tying wire 3 is cut. The formed loop is then twisted by means of a hook 6 to thereby tighten the loop, and the crossing portion 4 is thus bound together.

Figure 2:
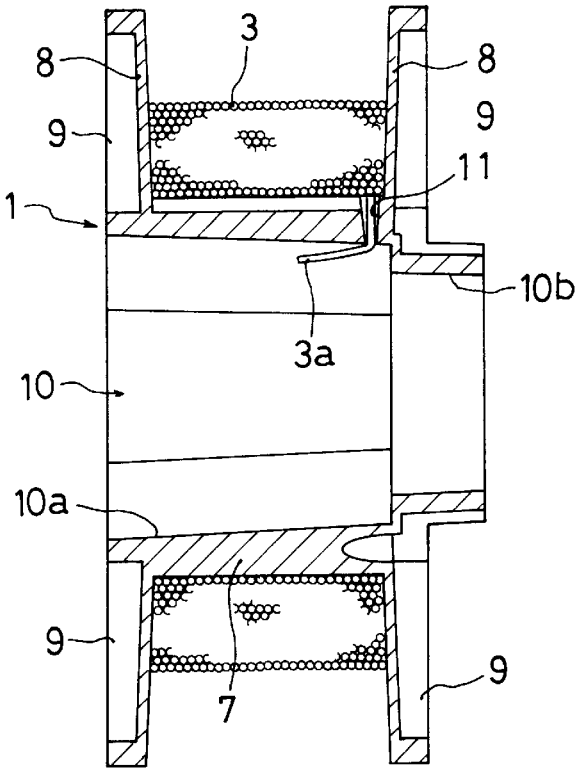
FIG. 2 is a sectional view of an important portion of the wire spool of the present invention.
Figure 3:
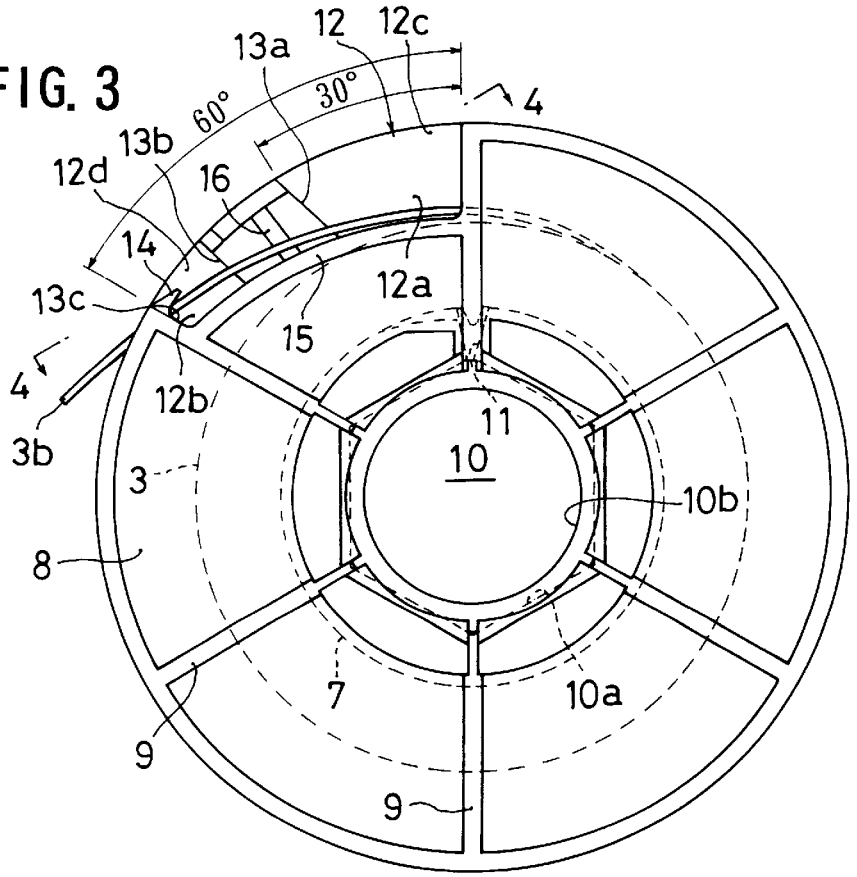
FIG. 3 is a side view of FIG. 2.

The wire spool 1 is arranged as shown in FIGS. 2 and 3. For example, it is formed by injection-molding a composite material (or a mixture) of a pulp and a synthetic resin. On both axial ends of a wire winding body 7, there are formed radially extending flanges 8, 8 which are integrally formed with the wire winding body 7 and are reinforced by radially extending ribs 9. In an axial center of the wire winding body 7, there is formed an axial hole 10 which is made up of a large-diameter hexagonal hole 10*a* and a small-diameter circular hole 10*b* which are communicated with each other. When the tying wire 3 is to be wound around the wire winding body 7, a driving shaft is inserted into the hexagonal hole 10*a* to thereby prevent the driving shaft from rotating relative to the wire spool 1. When the wire spool 1 is mounted on the binding machine 2, a supporting shaft of the binding machine 2 is inserted into the circular hole 10*b* of the wire spool 1 so that the wire spool 1 can be freely rotated when the tying wire 3 is pulled or withdrawn from the wire spool 1. The wire winding body 7 is provided with an engaging hole 11 which penetrates from an outer periphery of the wire winding body 7 into an inside of the hexagonal hole 10*b* in order to engage an initial or starting end of winding of the tying wire into the hole 11.

Figure 4:
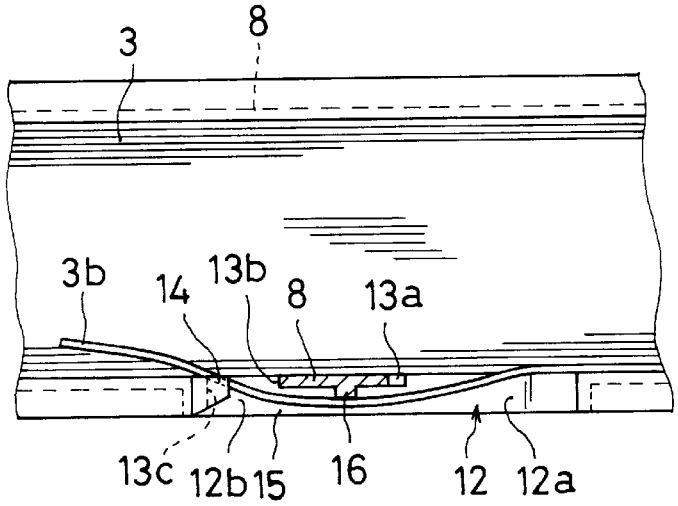
FIG. 4 is an enlarged view taken along the line 4—4 in FIG. 3.
Figure 5:
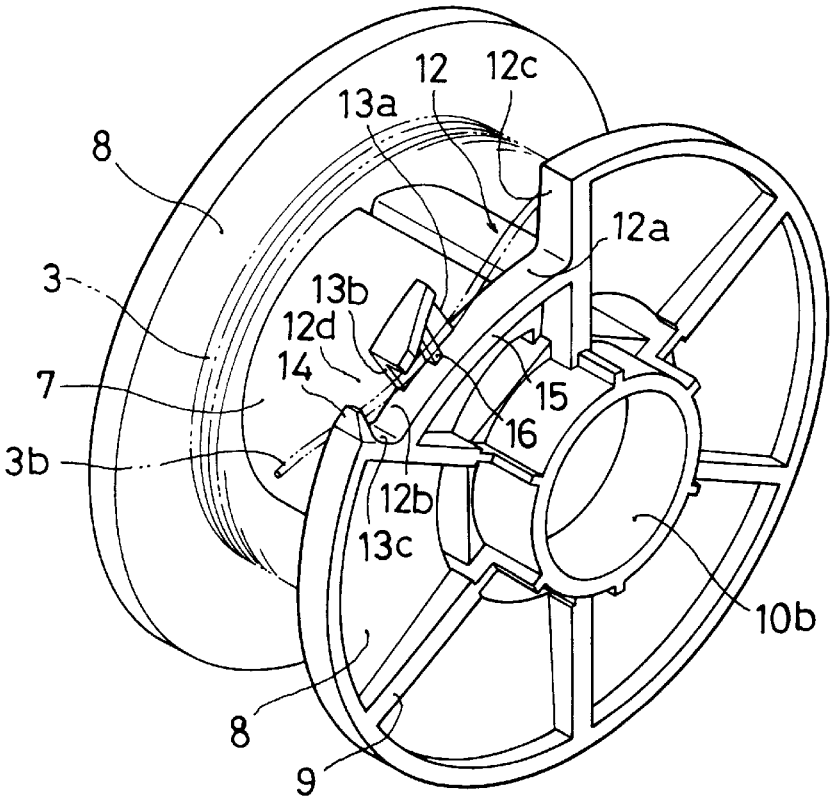
FIG. 5 is a perspective view of the wire spool of the present invention.

In order to fix or hold in position the wound terminal end 3*b* of the tying wire 3, there are formed on an outer periphery of one of the flanges 8 a pair of notches 12*a*, 12*b* which are close to each other as shown in FIG. 3. As shown in FIG. 4, the terminal end 3*b* of the tying wire 3 is once led or pulled out of the flange 8 through one 12*a* of the notches and is then returned into the wire winding body 7 through the other 12*b* of the notches. In more detail, between the sides which form one 12*a* of the notches, that side 13*a* which lies closer to the other 12*b* of the notches is formed into such an inclination as to expand the opening 12*c* toward the radially outside. Between the sides 13*b*, 13*c* which form the other 12*b* of the notches, the side 13*c* which lies farther (or away) from said one 12*a* of the notches is provided with an overhung portion 14 in such a manner that the opening portion 12*d* in the other 12*b* of the openings is narrowed at a radially outward end.

The tying wire 3 is pulled out of the wire spool 1 through the tying machine via a feeding mechanism (not illustrated), or the like, toward the bending guide 5. If the tying wire is subject to bending on the way, its smooth pulling out is hindered at the bent portion. It means that, if there is a bent portion in the tying wire 3, the feeding or withdrawing of the tying wire 3 cannot be smoothly performed. It is therefore preferable to avoid the presence or occurrence of a bent portion in the tying wire 3 also when the tying wire 3 is engaged with the notches 12. This is enabled by the following arrangement. Namely, by forming the inclined side in the notch 12*a* and by forming each of the notches 12*a*, 12*b* at an appropriate distance to each other, the tying wire 3 can be easily engaged with the notches 12*a*, 12*b* without bending the terminal end portion 3*b* of the tying wire 3. Furthermore, although the terminal end portion 3*b* tends to be sprung back or released out of engagement with the opening portion 12*d* due to the resilient characteristics of the tying wire 3, the overhung portion 14 which is formed in the other 12*b* of the notched portions functions to hold that portion of the tying wire 3 which is slightly away inwards from the terminal end portion 3*b* thereof against the resilient restoring force of the tying wire 3. As a result, the end portion 3*b* will not be easily released out of engagement with the notched portion 12*b*. In concrete, the notches 12*a*, 12*b* are formed in one of the flanges within a range of an angle of 60° from the center of the wire winding body 7. The side 13*a* is inclined such that the opening portion 12*c* opens at an angle of 30° in the periphery of the flange 8. The overhung portion 14 is formed to project by 3 mm in the circumferential direction toward the side 13*b*. The outer diameter of the flanges is 80 mm, and the hexagonal hole 10*a* is tapered with the largest diameter (or the distance between the opposite sides) being 17 mm. The inner diameter of the circular hole 10*b* is 23 mm. In the illustrated embodiment, the tying wire 3 is wound in the direction in which the terminal end portion 3*b* is engaged with the notches in the order of the notch 12*a* first followed by the notch 12*b*. Reference numerals 15, 16 are reinforcing ribs.

Figure 6:
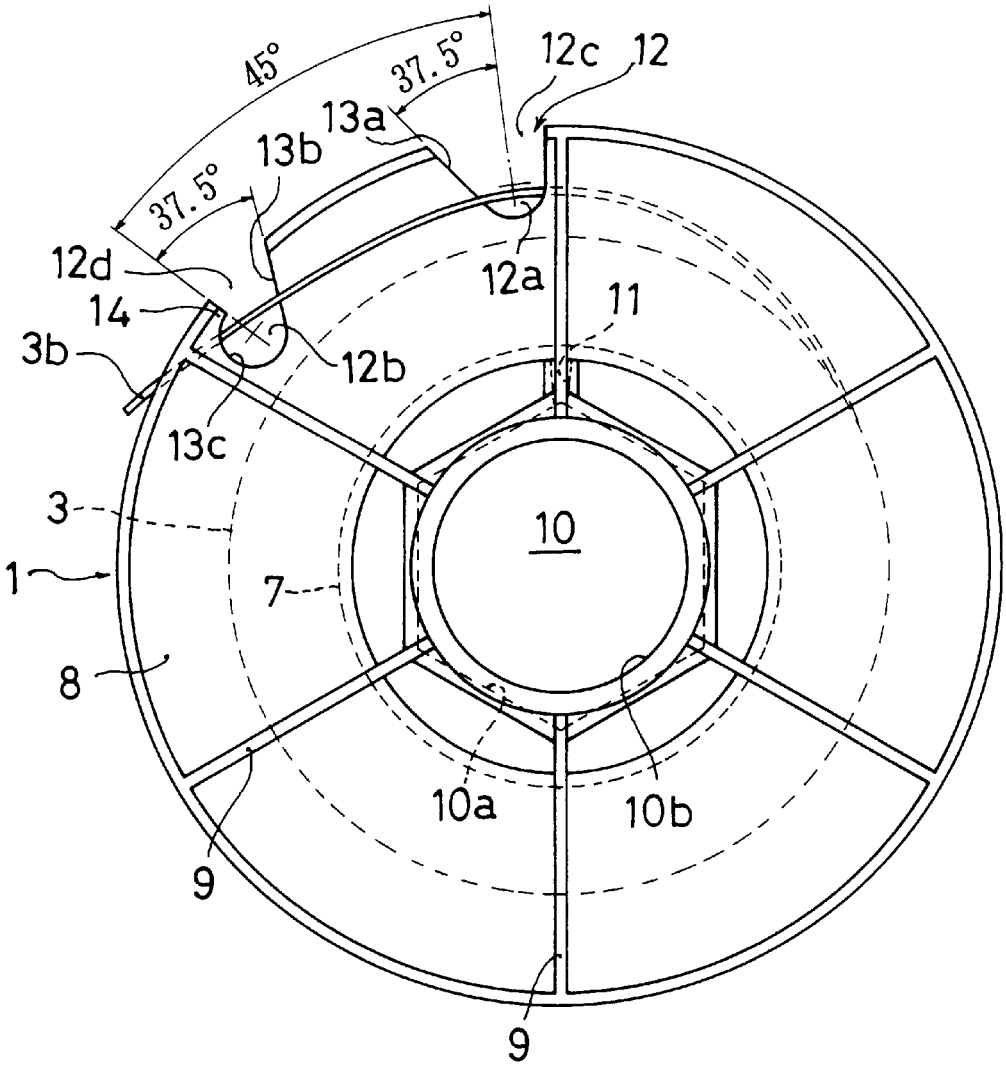
FIG. 6 is a side view of another embodiment of the wire spool of the present invention.

FIG. 6 shows another embodiment of the present invention. In this embodiment, a pair of notches 12*a*, 12*b* are formed in one of the flanges at a distance equivalent to an angle of 45° from the center of the wire winding body 7. Each of the sides 13*a*, 13*b* is inclined at an angle of 37.5° from the center of each of the notches 12*a*, 12*b*. The overhung portion 14 projects by 3 mm.

As explained hereinabove, a pair of notches for engaging the tying wire are formed in close proximity with each other on an outer periphery of one of the flanges of the wire spool. A side which forms one of the notches is inclined to expand the opening of the notch such that the radially outward portion of the notch becomes wider. Further, an overhung portion is provided in the other of the notched portions. Therefore, the terminal end of the tying wire can be easily engaged or held in position without bending the tying wire. Further, the engaging of the tying wire with the overhung portion can be easily released for further processing or using of the tying wire without an extra work, e.g., of peeling off the adhering tape which is otherwise needed in the conventional apparatus. The possibility of damaging the binding machine with the adhesive tape is eliminated. Further, by arranging that the wire winding body has a hole which is made up of a polygonal hole and an axial circular hole which is smaller in diameter than the polygonal hole, the winding of the tying wire can be performed easily.

It is readily apparent that the above-described wire spool meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A wire spool for winding therearound a tying wire comprising:

a cylindrical wire winding body;

a pair of flanges integrally formed on both axial ends of said wire winding body;

wherein one of said flanges has formed on an outer periphery thereof a pair of notches in close proximity to each other;

wherein, between those sides which form one of said notches, that side which lies closer to the other of said notches is formed so as to expand an opening of said one of said notches; and wherein, between those sides which form the other of said notches, that side which lies farther from said one of said notches is provided with an overhung portion so as to narrow an opening of the other of said notches.

2. A wire spool according to claim 1, wherein, among the sides which form the other of said notches, that side which lies closer to said one of said notches is inclined so as to expand the opening of the other of said notches.

3. A wire spool according to claim 1, wherein said wire winding body has a hole which is made up of a polygonal hole and an axial circular hole which is smaller in diameter than said polygonal hole, and wherein said wire winding body has a throughgoing hole which penetrates from an outer periphery of said wire winding body for engaging an inner terminal end of the tying wire.

4. A wire spool according to claim 2, wherein said wire winding body has a hole which is made up of a polygonal hole and an axial circular hole which is smaller in diameter than said polygonal hole, and wherein said wire winding body has a throughgoing hole which penetrates from an outer periphery of said wire winding body for engaging an inner terminal end of the tying wire.

* * * * *